US008139811B2

(12) United States Patent
Itoh et al.

(10) Patent No.: US 8,139,811 B2
(45) Date of Patent: Mar. 20, 2012

(54) SPEAKER

(75) Inventors: Daisuke Itoh, Tendo (JP); Teruaki Kaiya, Tendo (JP); Kenta Fujimoto, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 383 days.

(21) Appl. No.: 12/446,667

(22) PCT Filed: Nov. 17, 2006

(86) PCT No.: PCT/JP2006/323028

§ 371 (c)(1),
(2), (4) Date: Apr. 22, 2009

(87) PCT Pub. No.: WO2008/059597

PCT Pub. Date: May 22, 2008

(65) Prior Publication Data

US 2010/0034419 A1 Feb. 11, 2010

(51) Int. Cl.
*H04R 1/00* (2006.01)

(52) U.S. Cl. ..... 381/396; 381/398; 181/157; 181/171; 181/172

(58) Field of Classification Search ..... 381/396, 381/398; 181/157, 171, 172
See application file for complete search history.

(56) References Cited

U.S. PATENT DOCUMENTS

| | | | | |
|---|---|---|---|---|
| 6,236,733 | B1 * | 5/2001 | Kato et al. | 381/423 |
| 2005/0111690 | A1 * | 5/2005 | Onuma et al. | 381/424 |
| 2005/0141746 | A1 | 6/2005 | Kobayashi et al. | |

FOREIGN PATENT DOCUMENTS

| | | | |
|---|---|---|---|
| JP | 10-322795 | A | 12/1998 |
| JP | 2005-159506 | A | 6/2005 |
| JP | 2005-191746 | A | 7/2005 |
| JP | 2006-197259 | A | 7/2006 |

* cited by examiner

*Primary Examiner* — Richard A. Booth
(74) *Attorney, Agent, or Firm* — Sughrue Mion, PLLC

(57) ABSTRACT

A speaker 1 includes: a frame 4; a magnetic circuit 2; and a vibrating unit 3. The magnetic circuit 2 is attached to the frame 4. The vibrating unit 3 is received in the frame 4, and includes a drive cone 14 and a diaphragm 15 vibrated by the magnetic circuit 2. A space surrounded by the drive cone 14, the diaphragm 15 and the frame 4 is sealed. An edge unit 17 is attached to an outer edge of the drive cone 14. The edge unit 17 is in an arc sectional shape, and integrally includes two roll parts 47 arranged coaxially to each other.

14 Claims, 4 Drawing Sheets

SPEAKER

TECHNICAL FIELD

This invention relates to a speaker for generating sound by, for example, vibrating a diaphragm with a supply of voice currents.

BACKGROUND ART

Conventionally various speakers (for example, Patent Document 1) are mounted on a vehicle as a moving object. The speaker disclosed in Patent Document 1 includes: a cylindrical frame having a base plate; a vibrating unit received in the frame; and a magnetic circuit unit attached to the frame, and generating sound by vibrating the vibrating unit.

The frame of the speaker has a substantially cylindrical shape for attaching to a door of a vehicle. An attaching part having a specific opening is formed on the door to which the speaker is attached. It is difficult to freely change the size of the opening. Further, a receiving part for attaching the frame to the attaching part is formed on the frame. An inner diameter of the receiving part is substantially the same as an outer diameter of the attaching part.

Incidentally, if a projection projected outward is formed on a side wall of the frame, and an outer diameter of the projection is larger than the inner diameter of the receiving part, when the speaker is inserted into the attaching part, the attaching part contacts the projection so that the speaker cannot be attached to the door. Accordingly, an outer diameter of the frame of the speaker is formed in a substantially cylindrical shape such that the outer diameter is reduced as the receiving part extends from an inner periphery to a bottom.

The vibrating unit is received in the frame. The vibrating unit includes: a voice coil to which voice currents are supplied; a drive cone attached to the voice coil; a diaphragm; and two edge units. The center axes of the drive cone and the diaphragm are aligned (hereafter referred to as coaxial), and an outer diameter of the diaphragm is formed large. The diaphragm is arranged on a sound emission side relative to the drive cone.

For a purpose that the outer diameters of the diaphragm and the drive cone are substantially the same, the projection projected outward may be formed on the side wall of the frame, and the outer periphery of the drive cone may be attached to the projection. However, as above described, because there is a problem that the projection contacts the attaching part, the outer diameter of the diaphragm is formed larger than that of the drive cone.

Each of the two edge units is made of resin, and has an annular section. One of the two edge units is attached to an outer periphery of the diaphragm and the frame, and the other edge unit is attached to an outer periphery of the drive cone and the frame. The edge units allow the drive cone and the diaphragm to move in a vibration direction of the voice coil.

Further, a sectional shape of the one edge unit is formed in an arc shape projecting toward a sound emission direction, and a sectional shape of the other edge unit is formed in an arc shape projecting in a reverse direction of the sound emission direction. Further, because the outer diameter of the diaphragm is larger than that of the drive cone, inner and outer diameter of the one edge unit is larger than that of the other edge unit.

The magnetic circuit unit includes a permanent magnet, and the voice coil is disposed in a magnetic gap of the magnetic circuit.

In the speaker having the above described configuration, by supplying voice currents to the voice coil, electromagnetic force (Lorentz force) acts on the voice coil to vibrate the diaphragm and to generate sound corresponding to the voice currents in the sound emission direction.

Further, the speaker described above is a so-called air suspension speaker aiming for an improvement of reproduced sound quality and for a longer operating life by sealing a space surrounded by the drive cone, the diaphragm, the two edge units, and the frame.

[Patent Document 1] Japanese Published Patent Application No. 2005-191746

DISCLOSURE OF THE INVENTION

Problem to be Solved by the Invention

In the speaker disclosed in the Patent Document 1, when the voice currents are supplied to the voice coil, the drive cone transmits the vibration of the voice coil to the diaphragm, so that the diaphragm vibrates to generate sound. At this time, because the outer diameters of the drive cone and the diaphragm are different from each other, and the inner and outer diameters of the two edge units are different from each other, when the diaphragm vibrates, the other edge unit attached to the drive corn may be extended out before the one edge unit attached to the diaphragm is extended out. In this case, when the sound is reproduced with a large volume, the sound quality of the sound may be changed.

Further, when the other edge unit is extended out, folds are formed radially. When repeating the vibration of the diaphragm, the folds may change to cracks to break the edge unit.

The present invention aims for solving these problems. The object of the present invention is to provide a speaker, in which a space surrounded by a magnetic circuit unit, a diaphragm, and a frame is sealed, for preventing a change of the sound quality and for preventing an edge unit from being broken in particular with a large sound volume.

Means for Solving Problem

For attaining the object, according to claim 1 of the present invention, there is provided a speaker comprising:

a frame;

a magnetic circuit attached to the frame;

a diaphragm;

a voice coil to which voice currents are supplied; and a drive cone for transmitting a vibration of the voice coil to the diaphragm, wherein a space surrounded by the frame, the drive cone, and the diaphragm is sealed, and wherein an edge unit connected to the drive cone has an arc shaped section, and includes a plurality of roll parts arranged in a radial direction.

EXPLANATIONS OF LETTERS OR NUMERALS

Figure 1:
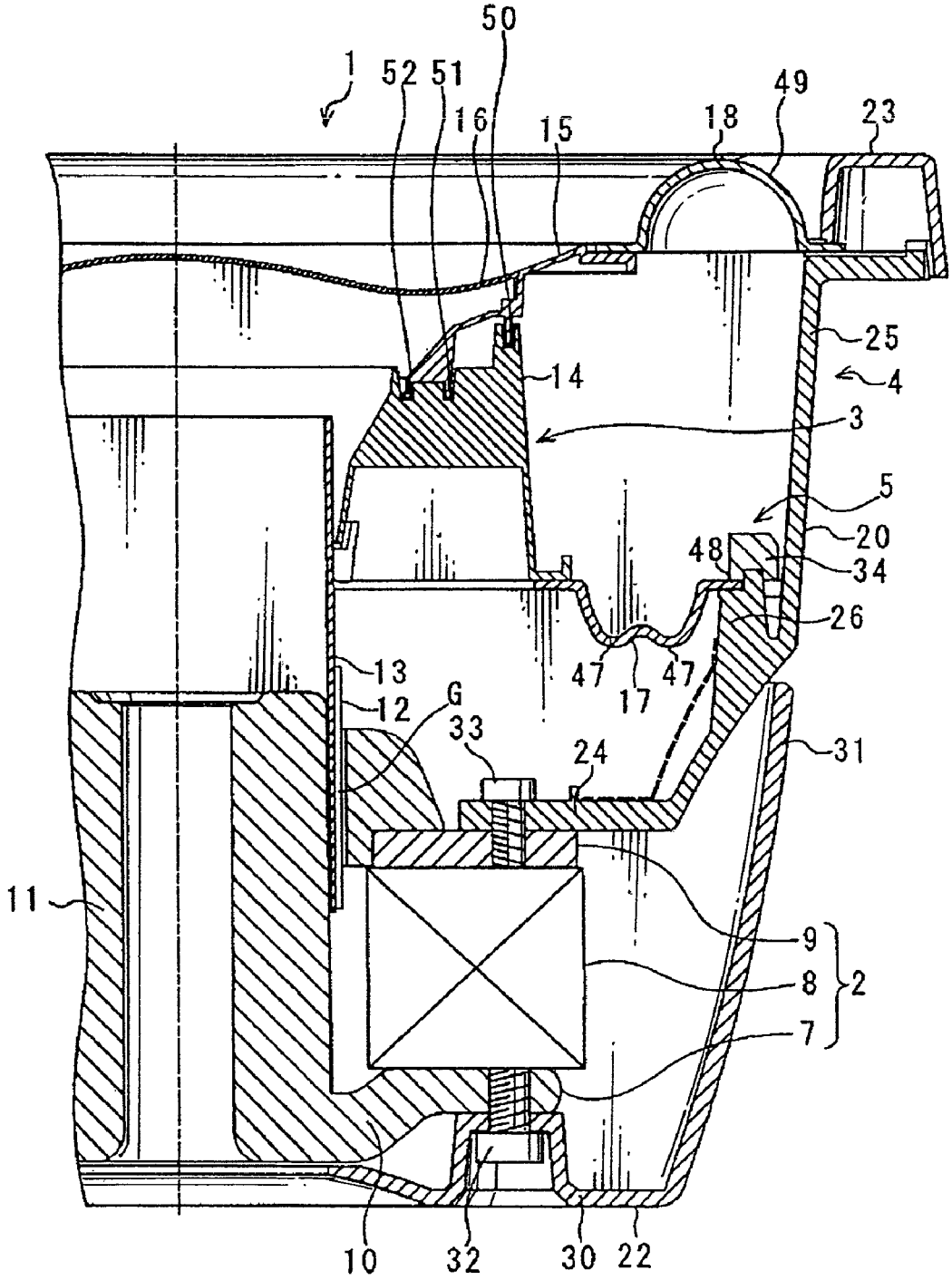
[FIG. 1 ]A sectional view showing a speaker according to an embodiment of the present invention.

1 speaker
2 magnetic circuit unit
3 vibrating unit
4 frame
12 voice coil
14 drive cone
15 diaphragm
17 edge unit (edge unit connected to the drive cone)
18 edge unit (edge unit connected to the diaphragm)
47 roll part
49 roll part
K space

BEST MODE FOR CARRYING OUT THE INVENTION

Hereafter, an embodiment according to the present invention will be explained. In a speaker according to the embodiment of the present invention, a length (effective length) of an edge unit is extended when the edge unit attached not to the diaphragm but to the drive cone is composed of a plurality of roll parts arranged coaxially to each other and arranged in a radial direction. Thus, in the speaker, the edge unit is prevented from extending out excessively, changing the sound quality, and being broken when repeating a vibration in particular with a large sound volume.

Further, a corrugation damper is deformed perpendicular to the center axis of a voice coil to prevent a vibrating unit, namely, the voice coil, a voice coil bobbin, the diaphragm, or the like from oscillating horizontally (perpendicular to the center axis of the voice coil). However, in this speaker, the drive cone and the diaphragm are not locally and largely deformed. Therefore, abnormal vibration such as seen in a rolling phenomenon to spoil sound quality and sibilating sound generated when the voice coil bobbin contacts a plate or a magnet are not generated, and high quality sound or clear sound can be reproduced.

The edge unit connected to the diaphragm may have a roll part. In this case, a length (effective length) of the edge unit connected to the diaphragm is prevented from extending longer than needs, and a difference between the lengths of the edge units attached to the diaphragm and attached to the drive cone can be reduced.

Further, the edge unit attached to the drive cone may have two roll parts. In this case, even when a total width of the edge unit (a distance from an inner periphery to an outer periphery of the edge unit) is short, the length of the edge unit can be long enough.

Further, the inner periphery of the edge unit may be connected to an outer periphery of the diaphragm, and the outer periphery may be attached to the frame. In this case, the edge unit can surely and vibratably support the diaphragm.

Further, a curvature radius of a section of the outer roll part (near the frame) may be smaller than that of the inner roll part (near the voice coil bobbin). In this case, because the rigidity of the outer roll part is larger than that of the inner roll part, in particular when the vibration of the diaphragm is large, namely, a large sound volume is reproduced, a deformation of the outer roll part is regulated, so that a deformation such as radial folds is prevented at the outer roll part, namely, outside of the edge unit. Therefore, in particular when a large sound volume is reproduced abnormal sound is prevented from being caused by radial folds at the outer roll part, namely, outside of the edge unit.

Further, a space surrounded by the drive cone, the diaphragm, and the frame may be a sealed space. In this case, the air in the space attenuates the vibration of the drive cone, so that a damper used in a conventional speaker is not needed. Therefore, a structure of the speaker can be simplified.

Embodiment

An embodiment of the present invention will be explained with reference to FIGS. 1 to 4. A speaker 1 according to the embodiment of the present invention shown in FIG. 1 is mounted on a vehicle as a moving object to provide voice information to crews in the vehicle.

As shown in FIG. 1, the speaker 1 includes: a frame 4; a magnetic circuit 2; a vibrating unit 3 for generating sound; and a wiring structure 5.

As shown in FIG. 1, the frame 4 includes: a frame main body 20; a not-shown frame for connector; a cover for the magnetic circuit unit 22; and a gasket 23.

The frame main body 20 is made of metal such as aluminum. The frame main body 20 includes: an annular bottom part 24; a cylinder part 25 extending upward from a periphery of the bottom part 24; and a flange part 26 projecting from an inner wall (inner side wall, inner peripheral wall) of the cylinder part 25.

The flange part 26 is formed in an annular shape and projected toward an inside of the cylinder part 25 from the inner wall of the cylinder part 25. The flange part 26 is extended in the whole circumference of the cylinder part 25 along the inner wall of the cylinder part 25. Further, a single hole 28 into which a later-described not-shown tube member is pressed is provided on the flange part 26. Of course, the hole 28 penetrates the frame main body 20, namely, the flange part 26 of the frame 4.

The frame for connector is attached to the frame main body 20. A connector for connecting to the above-described amplifier mounted on a vehicle is attached to the frame for connector. The connector may be connected to not only the amplifier but also other electronic components.

The cover for the magnetic circuit unit 22 includes an annular bottom part 30, and a cylinder part 31 extending upward from a periphery of the bottom part 30. The cover for the magnetic circuit unit 22 is fixed to a later-described yoke 7 of a magnetic circuit unit 2 with a bolt 32. A plate 9 and the frame main body 20 are fixed with a bolt 33. When the cover for the magnetic circuit unit 22 is fixed to the frame main body 20, the cover for the magnetic circuit unit 22 is made coaxial with the frame main body 20. Here, "coaxial" means that center axes of the cover for the magnetic circuit unit 22 and the frame main body 20 are substantially the same.

A gasket 23 is formed in an annular shape. The gasket 23 is overlapped with a periphery (outer circumference) of the frame main body 20, and sandwiches a later-described edge unit 18 with the periphery, and then, fixed to the frame main body 20 with such as an adhesive agent. The gasket 23 and the periphery of the frame main body 20 sandwiches the edge unit 18 so as to fix a later-described diaphragm 15 on the frame main body 20.

The magnetic circuit unit 2 is attached to the frame 4 by means that the magnetic circuit unit 2 is fixed to both the cover for the magnetic circuit unit 22 and the frame main body 20. As shown in FIG. 1, the magnetic circuit unit 2 includes: the yoke 7 made of magnetic material (so-called paramagnetic material or ferromagnetic material); a magnet 8; and the plate made of magnetic material (so-called paramagnetic material or ferromagnetic material). The yoke 7 is an external magnet type magnetic circuit integrally including: an annular bottom plate 10; and a cylindrical center pole 11 extending from an inner edge locating centrally in the bottom plate 10. In this embodiment, the external magnet type magnetic circuit is disclosed. However, according to the present invention, an internal magnet type magnetic circuit or a magnetic circuit using both the internal magnet and the external magnet (magnetic circuit having magnets both inside and outside of the voice coil bobbin) can be used. Further, according to this embodiment, an opening communicating with an outside of the speaker is provided on the center pole 11. However, according to the present invention, it is acceptable that the opening may not be provided.

The magnet 8 is formed in an annular shape. An inner diameter of the magnet 8 is larger than an outer diameter of the center pole 11. The magnet 8 is overlapped with the bottom plate 10 while the center pole 11 is disposed in an inside of the magnet 8. The above-described magnet 8 may be a magnet excited by a permanent magnet or by a DC power source.

The plate 9 is formed in an annular shape. An inner diameter of the plate 9 is larger than the outer diameter of the center pole 11. The plate 9 is overlapped with the magnet 8 while the center pole 11 of the yoke 7 and a later-described voice coil bobbin 13 are disposed in an inside of the plate 9. The yoke 7, the magnet 8, and the plate 9 are arranged coaxially to each other, namely, the center axes thereof are arranged substantially the same. Therefore, inner circumferential walls of the magnet 8 and the plate 9 are separated from an outer circumferential wall of the center pole 11 of the yoke 7.

Further, the above-described yoke 7 is fixed on the cover for the magnetic circuit unit 22 with the bolt 32 penetrating the cylindrical bottom part 30 and the bottom plate 10. Further, the bolt 33 penetrating the bottom part 24 of the frame main body 20 is screwed into the plate 9 to fix the plate 9 to the frame main body 20. Thus, the magnetic circuit unit 2 is fixed to the frame 4 by means that the plate 9 is fixed to the frame main body 20, and the bottom plate 10 is fixed on the cover for the magnetic circuit unit 22. Of course, the yoke 7, the magnet 8, and the plate 9 are arranged coaxially with the frame 4.

According to the above-described structure, in the magnetic circuit unit 2, a magnetic gap G having a large magnetic flux density is formed between the outer peripheral wall of the center pole 11 of the yoke 7 and the inner peripheral wall of the plate 9. Namely, in the magnetic gap G, the magnetic circuit unit 2 makes the electromagnetic force (Lorentz force) acting on a voice coil 12 to vibrate the diaphragm 15.

The vibrating unit 3 is received in the frame main body 20 of the frame 4. The vibrating unit 3 includes the voice coil 12, the voice coil bobbin 13, a drive cone 14, the diaphragm 15, and a center cap 16. Namely, the vibrating unit 3 includes the drive cone 14 and the diaphragm 15. In this embodiment, two voice coils are provided, and two voice coil bobbins 13 are wound integrally (not shown). Further, before the diaphragm 15 is vibrated, the voice coils are arranged coaxially to each other, and disposed in the above-described magnetic gap G of the magnetic circuit unit 2. Voice currents are supplied to the voice coil 12.

The voice coil bobbin 13 is formed in a cylinder shape. An inner diameter of the voice coil bobbin 13 is larger than the outer diameter of the center pole 11 of the yoke 7. An outer diameter of the voice coil bobbin 13 is smaller than the inner diameters of the plate 9 and the magnet 8. The voice coil bobbin 13 is arranged coaxially with the yoke 7, the plate 9, and the voice coil 12. One end of the voice coil bobbin 13 is inserted into the magnetic gap G, and the voice coil 12 is attached to the periphery of the one end of the voice coil bobbin 13. The voice coil bobbin 13 is movably supported along the center axis of the yoke 7 by the drive cone 14 and the diaphragm 15. The center axes of the yoke 7 and the voice coil bobbin 13 are substantially the same as that of the speaker 1.

The drive cone 14 transmits the vibration of the voice coil 12 to the later-described diaphragm 15. The drive cone 14 is made of resin or the like. The drive cone 14 is formed in an annular shape, and an inner edge thereof is attached to an outer wall of the other end of the voice coil bobbin 13 in the center axis direction. Therefore, the drive cone 14 is attached to the voice coil 12 via the voice coil bobbin 13.

Figure 2:
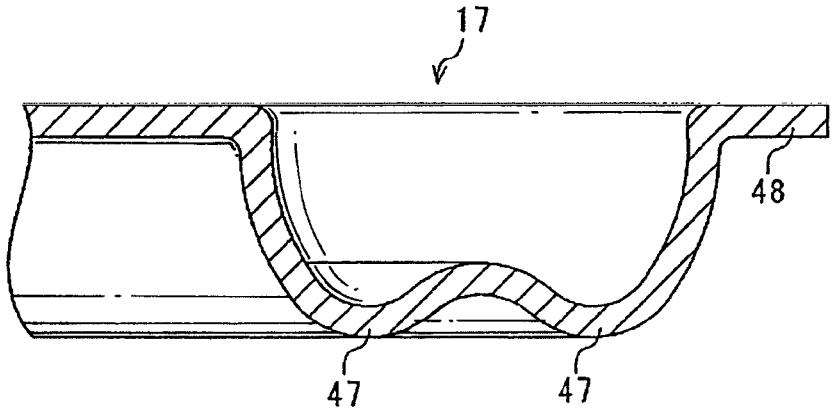
[FIG. 2 ]A sectional view showing a main part of an edge unit of the speaker shown in FIG. 1.

An inner edge of a thin plate shaped edge unit 17 is attached (connected) to an outer edge of the drive cone 14 with the adhesive agent or the like. The edge unit 17 is made of such as rubber or resin (namely, elastic material). The edge unit 17 is formed in an annular shape surrounding the drive cone 14. As shown in FIG. 2, the edge unit 17 integrally includes a plurality of roll parts 47 and a flange formed at an outer edge thereof.

In FIG. 2, two roll parts are provided. Each roll part 47 is formed in an annular shape to surround the drive cone 14, and a sectional shape of the roll part 47 is in a thin-plate and an arc. Curvature radii of the sections of the two roll parts 47 are substantially the same. The two roll parts 47 are arranged coaxially to each other, and in a radial direction of the edge unit 17, namely, the speaker 1. Namely, one roll part 47 is arranged at an inside of the other roll part 47. Further, an outer edge of the one roll part 47 is continued to an inner edge of the other roll part 47. A planar shape of the flange 48 is an annular shape, and a sectional shape of the flange 48 is a plane shape. The roll parts 47 are arranged in an inside of the flange 48, and an inner edge of the flange 48 is continued to an outer edge of the above-described other roll part 47. Namely, the flange 48 is projected outward from the other roll part 47. The flange 48 is coaxial to the two roll parts 47.

In the edge unit having the above-described structure, the flange 48 (namely, the outer edge) is sandwiched between a flange part 26 of the frame main body 20 and a later-described positioning member 34 of the wiring structure 5, and fixed to them. Namely, the drive cone 14 is attached to the frame main body 20, namely, the frame 4 via the edge unit 17. Further, the elastically deformable edge unit 17 attaches the drive cone 14 to the frame 4 movably in the center axis direction. Further, in this embodiment, the edge unit 17 is attached to the frame 4, and both sections of the two roll parts 47 are projected with arc shapes in a direction opposite to the sound emission direction.

The diaphragm 15 is made of resin or the like. The diaphragm 15 is formed in an annular shape. An inner diameter of the diaphragm 15 is larger than an inner diameter of the drive cone 14, and an outer diameter of the diaphragm 15 is larger than an outer diameter of the drive cone 14. The diaphragm 15 is fixed on a part of the drive cone 14, in particular, grooves thereof indicated by reference numbers 50, 51, 52 in FIG. 1 with the adhesive agent or the like.

Further, the diaphragm 15 is arranged coaxially to the drive cone 14. The thin plate shaped edge unit 18 having a semicircular section is attached to the outer edge of the diaphragm 15 with the adhesive agent or the like. The edge unit 18 includes a single roll part 49 of which section is in an arc shape projected in the sound emission direction. The edge unit 18 is made of rubber or resin (namely, the elastic material). An outer edge of the edge unit 18 is sandwiched between an outer edge of the cylinder part 25 of the frame main body 20 and the gasket 23, and thus, the edge unit 18 is fixed to these. Namely, the diaphragm 15 is attached to the frame main body 20, namely, the frame 4 via the edge unit 18. Further, the elastically deformable edge unit 18 attaches the diaphragm 15 to the frame 4 movably in the center axis direction of the speaker 1. Thus, the speaker 1 includes a plurality of edge units (two in FIG. 1).

The center cap 16 is made of resin or the like. The center cap 16 is in a circular shape. A sectional shape of the center cap 16 is a convex shape in the center thereof in a sound emission direction, and a concave shape from the center toward an outer edge thereof. An outer diameter of the center cap 16 is larger than the inner diameter of the diaphragm 15, and is smaller than the outer diameter of the diaphragm 15. An outer edge of the center cap 16 is overlapped with the diaphragm 15, and attached to the diaphragm 15 along a whole periphery with the adhesive agent or the like.

The above-described drive cone 14, the diaphragm 15, and the center cap 16 of the vibrating unit 3 are, of course, arranged coaxially to the frame 4 and the magnetic circuit unit 2. In the vibrating unit 3, when the voice currents corresponding to voice data is supplied to the voice coil 12, the drive cone 14 transmits the vibration of the voice coil 12 to the diaphragm 15, and the diaphragm 15 vibrates along the above-described center axis to generate sound corresponding to the voice currents.

Further, a space K surrounded by the above-described drive cone 14, the diaphragm 15, the edge units 17, 18, and an inner wall of the frame 4 of the frame main body 20 is sealed. Namely, the space K surrounded by the drive cone 14, the diaphragm 15, the edge units 17, 18, and the inner walls of the frame 4 of the frame main body 20 is hermetically-closed.

Therefore, when the voice coil bobbin 13 of the above-described vibrating unit 3 vibrates with the voice coil 12, and the vibration of the voice coil 12 is transmitted to the drive cone 14 and the diaphragm 15. Then, because an air in the space K between the drive cone 14 and the diaphragm 15 is repeatedly compressed and expanded due to displacement of the drive cone 14 and the diaphragm 15 and displacement of the edge units 17, 18, an air spring is developed.

In this embodiment, when an effective area of the diaphragm 15 is S1, an effective area of the drive cone 14 is S2, the difference S is expressed by S=S1−S2. Further, when a volume of the air in the sealed space K between the drive cone 14 and the diaphragm 15 is V, a stiffness constant indicating the spring characteristic of the air spring is proportional to S/V. Namely, in this embodiment, the spring characteristic as the air spring occurs based on the air in the sealed space K between the drive cone 14 and the diaphragm 15 allows to regulate an abnormal behavior such that the diaphragm 15 vibrates in very large amplitude, to reproduce an acoustic characteristic of the speaker 1 for a long time, and to maintain reliability of the speaker 1 even when the diaphragm 15 vibrates in large amplitude for a long time.

As shown in FIG. 1, the wiring structure 5 includes: the positioning member 34; a plurality of not-shown tinsel wires; a plurality of not-shown lead wires; and a tube member. The positioning member 34 is formed in an annular shape, and an outer diameter of the positioning member 34 is equal to an inner diameter of the cylinder part 25 of the frame main body 20.

The positioning member 34 and the flange part 26 sandwich the flange 48, and the positioning member 34 is fixed on the flange part 26, namely, the frame main body 20 with a not-shown bolt, the adhesive agent, or the like. One end of the tinsel wire is connected to the voice coil 12, and the other end is attached to a terminal of the positioning member 34. The lead wire is a so-called covered wire having a conductive core wire and an insulating cover. One end of the lead wire is attached to the terminal of the positioning member 34, and the other end is attached to a terminal of a connector of a connector frame, and connected to the voice coil 12 via the tinsel wire.

The tube member is made of rubber, and formed in a tubular shape. The tube member may be made of resin or the like other than rubber. The tube member is so shaped that the rubber surrounds each of four lead wires by insert molding. The lead wires are inserted into an inside of the tube member 38, and the tube member is pressed into a hole of the frame main body 20, and guides the lead wires to an outside of the space K When the drive cone 14 and the diaphragm 15 vibrate, the tube member keeps the space K sealed so that the air in the space K may not leak. Further, as described the above, it is preferable that the tube member is made of elastic rubber for keeping the space K sealed.

The above-described wiring structure 5 is assembled by attaching the tinsel wires and the lead wires to the terminal, by pressing the tube member into which all of the lead wires are inserted into the hole, and by attaching the lead wires to the terminal of the connector. Then, by connecting sequentially the lead wires, the tinsel wires, and the voice coil 12 in series, the wiring structure 5 supplies the voice currents from the terminal of the connector to the voice coil 12.

According to the speaker 1 having the above-described structure, the voice currents are supplied to the voice coil 12 via the lead wires in the wiring structure 5, and the voice coil 12 disposed in the magnetic gap G vibrates along the center axis corresponding to the voice currents. Then, the voice coil bobbin 13 around the periphery of the voice coil 12 is wound, the drive cone 14, and the diaphragm 15 vibrates along the center axis of the speaker 1. Namely, the vibration of the voice coil 12 is transmitted to the diaphragm 15 via the drive cone 14, and the diaphragm 15 vibrates to generate sound corresponding to the voice currents.

According to this embodiment, because the edge unit 17 connected to the drive 14 cone, of which outer diameter is smaller than that of the diaphragm 15, is composed of a plurality of roll parts 47 coaxially to each other and arranged in a radial direction, a length (effective length) of the section of the edge unit 17 becomes large. Therefore, the speaker 1 prevents the edge unit 17 from extending out excessively, and in particular, prevents the edge unit 17 from being broken when repeating the change of the sound quality and the vibration of the reproduced sound with a large volume.

The edge unit 18 connected to the diaphragm 15 includes a single roll part 49. Therefore, the length (effective length) of the edge unit 18 connected to the diaphragm 15 is prevented from being larger than necessary, and a difference between the length of the edge unit 18 and the length of the edge unit 17 attached to the drive cone 14 is regulated.

Further, the corrugation damper is deformed perpendicular to the center axis of the voice coil 12 to prevent the vibrating unit, namely, the voice coil 12, the voice coil bobbin 13, the diaphragm 15, or the like from oscillating horizontally (perpendicular to the center axis of the voice coil 12). However, in this speaker 1, the drive cone 14 and the diaphragm 15 are not locally and largely deformed. Therefore, abnormal vibration such as seen in a rolling phenomenon to spoil sound quality and sibilating sound generated when the voice coil bobbin 13 contacts the plate 9 or the magnet 8 are not generated, and high quality clear sound can be reproduced.

Further, the edge unit 17 attached to the drive cone 14 includes two roll parts 47. In this case, even a whole width (a distance from an inner edge to an outer edge) of the edge unit 17 is small, the enough length of the edge unit 17 in the cross-section can be provided.

Further, an inner edge of the edge unit 18 is connected to an outer edge of the diaphragm 15, and an outer edge of the edge unit 18 is attached to the frame 4. Therefore, the edge unit 18 surely supports movably the diaphragm 15.

Figure 3:
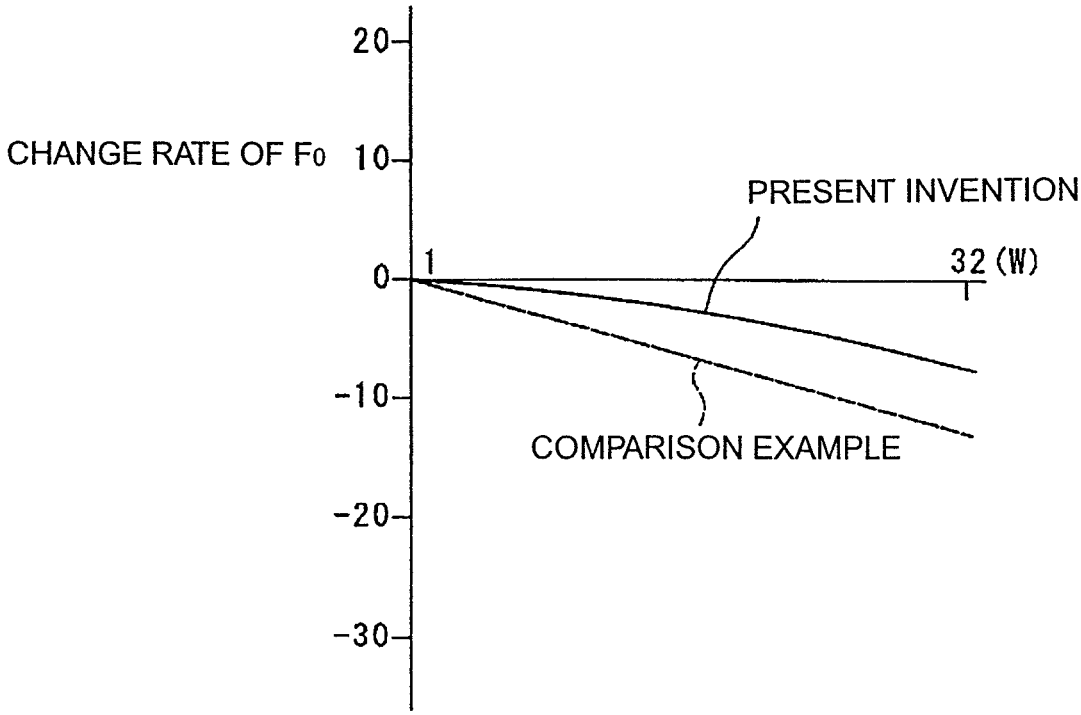
[FIG. 3 ]An explanatory view showing a difference of the lowest resonance frequency between the present invention and a comparison example.
Figure 4:
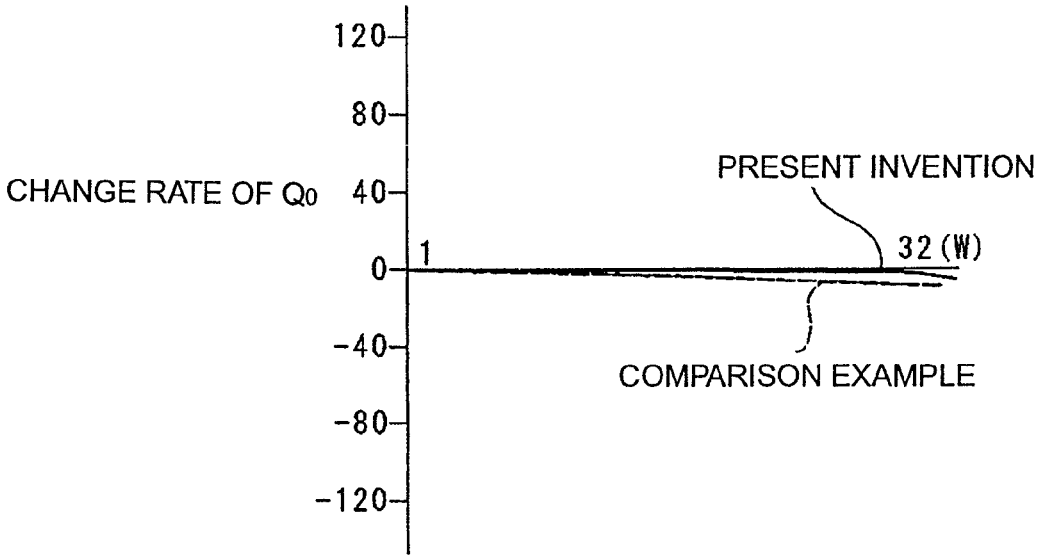
[FIG. 4 ]An explanatory view showing a difference of resonance sharpness between the present invention and the comparison example.

Next, inventors of the present invention have confirmed an effect of the speaker 1 according to the above-described embodiment. Results are shown in FIGS. 3 and 4. Comparison examples shown by the dotted lines in FIGS. 3 and 4 correspond to a speaker using an edge unit having the single roll part disclosed in the Patent Document 1. Present inventions shown by the solid lines in FIGS. 3 and 4 correspond to the speaker 1 using the edge unit 17 having the two roll parts 47 similar to the above-described embodiment.

FIG. 3 shows a change of a lowest resonance frequency (f0) when applying power of 1 W to 32 W to the voice coils of the speakers of the present invention and the comparison example. The horizontal axis indicates the power, and the vertical axis indicates a change rate of the lowest resonance frequency. FIG. 4 shows a change of a quality factor (Q0) when applying power of 1 W to 32 W to the voice coils of the speakers of the present invention and the comparison example. The horizontal axis indicates the power, and the vertical axis indicates a change rate of the quality factor.

According to FIGS. 3 and 4, it is clear that the both change rate of the lowest resonance frequency (f0) and the quality factor (Q0) of the present invention are smaller than those of the comparison example. Namely, a change of the sound quality of the present invention is smaller than that of the comparison example.

Further, in the speaker 1, the air spring, which the air in the sealed space K between the drive cone 14 and the diaphragm 15 develops, absorbs vibrating energy of the voice coil bobbin 13, the drive cone 14, and the diaphragm 15 to attenuate the vibration of the drive cone 14, the diaphragm 15, and the voice coil bobbin 13. Therefore, it is unnecessary to provide a damper as the conventional speaker includes. Namely, in the speaker 1 according to this embodiment, the drive cone 14 and the diaphragm 15 themselves work as the damper to attenuate the vibration of the drive cone 14, the diaphragm 15, and the voice coil bobbin 13. Therefore, it is unnecessary to equip the damper for supporting the voice coil bobbin 13 at a back side of the drive cone 14 and the diaphragm 15. Therefore. a size of the speaker 1 in the direction of the speaker 1 can be reduced by omitting the damper and a space for installing the damper, and a slim speaker 1 required by an audio system mounted on a vehicle can be realized.

Further, the drive cone 14 is disposed coaxially at a back side of the diaphragm 15 for realizing the sealed space K between the drive cone 14 and the diaphragm 15. This drive cone 14 may be made of the same material as the diaphragm 15. When comparing with a conventional corrugation damper, mechanical fatigue is less likely to occur. Therefore, reliability reduction of the speaker 1 caused by the mechanical fatigue of the components is prevented, and the life time of the speaker 1 can be increased.

Further, the corrugation damper is deformed perpendicular to the center axis of the voice coil to prevent the vibrating unit, namely, the voice coil, the voice coil bobbin, the diaphragm, or the like from oscillating horizontally (perpendicular to the center axis of the voice coil). However, in this speaker 1, the drive cone 14 and the diaphragm 15 are not locally and largely deformed. Therefore, abnormal vibration such as seen in a rolling phenomenon to spoil sound quality and sibilating sound generated when the voice coil bobbin 13 contacts the plate 9 or the magnet 8 are not generated, and high quality clear sound can be reproduced.

In the speaker 1 according to this embodiment, when the diaphragm 15 vibrates, the air in the sealed space K between the drive cone 14 and the diaphragm 15 is repeatedly compressed and expanded. Therefore, the edge units 17, 18 of the drive cone 14 and the diaphragm 15 are less likely to be deformed due to air pressure (back pressure) received at the back side. Therefore, without generating the abnormal vibration or the sibilating sound, the drive cone 14 and the diaphragm 15 can vibrate with large amplitude, and loud sound can be reproduced. Further, owing to the drive cone 14 and the edge unit 17, it becomes possible that the air spring developed by the air in the space K prevents abnormal behavior of the diaphragm 15 vibrating with very large amplitude, that the acoustic characteristic of the speaker 1 is reproduced continuously, that the acoustic characteristic of the speaker 1 is reproduced for a long time, and that reliability of the speaker 1 is maintained even when the diaphragm 15 vibrates with large amplitude for a long time.

In the above-described embodiment, two roll parts 47 compose the edge unit 47 supporting the drive cone 14. However, according to the present invention, three roll parts 47 may compose the edge unit 47. In short, according to the present invention, the edge unit 47 connected to the drive cone 14 needs is to include a plurality of roll parts 47. Further, according to the present invention, preferably, the edge unit 48 connected to the diaphragm 15 includes a single roll part 49.

Figure 6:
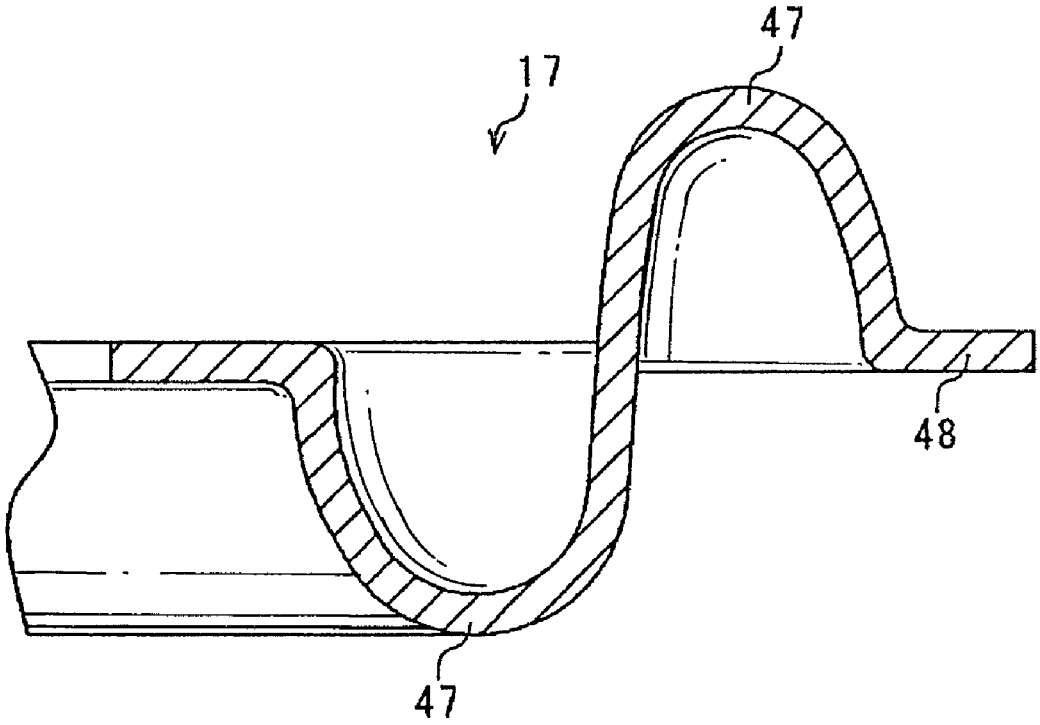
[FIG. 6 ]A sectional view showing a main part of another embodiment of the edge unit shown in FIG. 2.

Further, according to the above-described embodiment, all the roll parts 47 project in the direction opposite to the sound emission direction. However, according to the present invention, as shown in FIG. 6, the roll part 47 may projects in the sound emission direction. Incidentally, in FIG. 6, an outer roll part 47 projects in the sound emission direction, and an inner roll part 47 projects in the direction opposite to the sound emission direction. In short, according to the present invention, each roll part 47 may project in the sound emission direction, and may project in the direction opposite to the sound emission direction.

Figure 5:
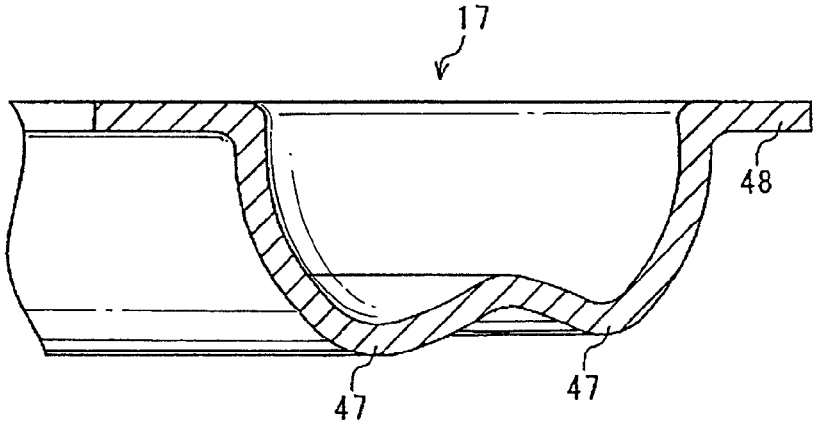
[FIG. 5 ]A sectional view showing a main part of another embodiment of the edge unit shown in FIG. 2.

Further, according to the above-described embodiment, the curvature radii of the sections of all the roll parts 47 are substantially the same. However, according to the present invention, as shown in FIG. 5, the curvature radius of the section of the outer roll part 47 may be smaller than that of the inner roll part 47. In this case, because rigidity of the outer roll part 47 is larger than that of the inner roll part 47, when the amplitude of the diaphragm 15 is large, namely, when the large sound volume is generated, deformation of the outer roll part 47 is regulated and the deformation such as radial folds on the outer roll part 47 is prevented from generating, namely, the edge unit 17 from being deformed such as radial folds. Therefore, in particular, when a large sound volume is generated, the deformation such as radial folds on the outer roll part 47, namely, the edge unit 17 is prevented, and abnormal sound is prevented from generating because of a crack on the edge unit, and the edge unit 17 is prevented from being broken. According to the present invention, more than two roll parts 47 can be provided, in short, it is preferable that the curvature radius of the section of the outermost roll part 47 be smaller than that of the innermost roll part 47.

According to the above-described embodiment, the speaker 1 described below is obtained.

(Note) a speaker 1 comprising:

a frame 4;

a magnetic circuit 2 attached to the frame 4;

a diaphragm 15;

a voice coil 12 to which voice currents are supplied; and a drive cone 14 for transmitting a vibration of the voice coil 12 to the diaphragm 15, wherein an edge unit 17 connected to the drive cone 14 has an arc shaped section, and includes a plurality of roll parts 47 arranged in a radial direction.

According to the Note, because the edge unit 17 attached to the drive cone 14 includes a plurality of roll parts 47 arranged in the radial direction, the length of the section of the edge unit 17 becomes large. Therefore, in the speaker 1, the edge unit 17 is prevented from extending out excessively, and in particular, a change of a sound quality with a large sound volume, and breaking of the edge unit 17 when repeating a vibration are prevented.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A speaker comprising:

a frame;

a magnetic circuit attached to the frame; and a vibrating unit having a diaphragm, a voice coil to which voice currents are supplied, a drive cone for transmitting a vibration of the voice coil to the diaphragm, and first and second edge units, wherein the diaphragm is supported by the frame with the first edge unit, wherein the drive cone is supported by the frame with the second edge unit, and the outer edge of the diaphragm is connected to the first edge unit, an inner edge of the drive cone is connected to the voice coil and an outer edge unit of the drive cone is connected to the second edge, the diaphragm is connected to a part between the inner edge and the outer edge of the drive cone, wherein the second edge unit is formed in an arc shaped section, and the arc shaped section includes a plurality of roll parts arranged in a radial direction.

2. The speaker as claimed in claim 1, wherein the second edge unit is disposed lower than the first edge unit.

3. The speaker 1 as claimed in claim 2, wherein an outer edge of the drive cone is disposed lower than a connection between the diaphragm and the first edge unit, and extends near the connection in a direction from the voice coil to the frame.

4. The speaker as claimed in claim 3, wherein the roll parts of the second edge unit are disposed lower than an outer periphery of the drive cone.

5. The speaker as claimed in claim 4, wherein the second edge unit includes a first roll part projected in a sound emission direction, and a second roll part projected in a direction opposite to the sound emission direction, and wherein the second edge unit includes a plurality of second roll parts sandwiching the first roll part.

6. The speaker as claimed in claim 5, wherein a tip of the first roll part is disposed lower than the outer edge of the drive cone, and wherein a tip of the second roll part is disposed lower than the tip of the first roll part.

7. The speaker as claimed in claim 6, wherein the tip of the first roll part is disposed in the side of an outer periphery of the second edge unit in respect to the central position between the tips of the second roll parts.

8. The speaker as claimed in claim 6, wherein a curvature radius of a section of the second roll part disposed outermost in a plurality of second roll parts is smaller than that of the second roll part disposed innermost in the other second roll parts.

9. The speaker as claimed in claim 4, wherein the second edge unit includes a first roll part projected in a sound emission direction and a second roll part projected in a direction opposite to the sound emission direction, and wherein the first and the second roll parts are adjacent to each other.

10. The speaker as claimed in claim 6, wherein a part between an inner edge and an outer edge of the drive cone is connected to a part between an inner edge and an outer edge of the diaphragm.

11. The speaker as claimed in claim 10, wherein the part between the inner edge and the outer edge of the drive cone is directly connected to the inner edge of the diaphragm.

12. The speaker as claimed in claim 1, wherein the vibrating unit includes a center cap, and wherein an outer edge of the center cap is supported by the diaphragm.

13. The speaker as claimed in claim 12, wherein a part between an inner edge and an outer edge of the diaphragm supports the center cap, and wherein the inner edge of the diaphragm is supported by the drive cone.

14. The speaker as claimed in claim 11, wherein a plurality of the edge units have air tightness, and wherein a space surrounded by the frame and the vibrating unit is sealed.

* * * * *